US006425163B1

(12) United States Patent
von Gehlen

(10) Patent No.: US 6,425,163 B1
(45) Date of Patent: Jul. 30, 2002

(54) COILER CAN HAVING A VERTICALLY MOVABLE BOTTOM

(75) Inventor: Walter von Gehlen, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/930,289

(22) Filed: Aug. 16, 2001

(30) Foreign Application Priority Data

Aug. 16, 2000 (DE) ..... 100 40 066

(51) Int. Cl.[7] ..... D04H 11/00
(52) U.S. Cl. ..... 19/159 R; 19/157
(58) Field of Search ..... 19/65 A, 150, 19/157, 159 A, 159 R; 57/1 R, 90, 268, 281; 206/388; 141/270; 242/361.3, 361.4, 361.5, 363

(56) References Cited

U.S. PATENT DOCUMENTS

| | | | | |
|---|---|---|---|---|
| 2,018,261 A | | 10/1935 | Holdsworth | |
| 2,478,960 A | * | 8/1949 | Wilkie | 19/159 R |
| 2,630,243 A | | 3/1953 | Longstreet | |
| 3,053,410 A | | 9/1962 | Eaddy | |
| 3,316,609 A | | 5/1967 | Russo | |
| 3,971,521 A | * | 7/1976 | Crotti | 19/159 R |
| 4,261,079 A | * | 4/1981 | Masini et al. | 19/159 R |
| 5,446,946 A | * | 9/1995 | Leifeld | 19/159 R |
| 5,491,877 A | * | 2/1996 | Leifeld | 19/159 R |
| 5,575,040 A | * | 11/1996 | Leifeld et al. | 19/159 R |
| 5,787,553 A | * | 8/1998 | Liedgens | 19/159 R |

FOREIGN PATENT DOCUMENTS

| | | |
|---|---|---|
| CH | 569 657 | 11/1975 |
| DE | 1 261 052 | 2/1968 |
| DE | 1 247 935 | 3/1968 |
| DE | 93 20 355 | 9/1994 |
| DE | 44 07 849 | 11/1994 |
| DE | 196 11 500 | 1/1997 |
| DE | 298 14 372 | 1/1999 |
| DE | 198 13 538 | 9/1999 |
| FR | 2 692 238 | 12/1993 |

* cited by examiner

*Primary Examiner*—Danny Worrell
*Assistant Examiner*—Gary L. Welch
(74) *Attorney, Agent, or Firm*—Venable; Gabor J. Kelemen

(57) ABSTRACT

A coiler can for accommodating sliver includes a vertical wall defining an inner can space and a can top through which sliver may be deposited into and withdrawn from the can space; a vertically shiftable bottom disposed in the inner can space; and a tension device connected to the shiftable bottom and exerting a pulling force thereto toward the can top.

10 Claims, 3 Drawing Sheets

COILER CAN HAVING A VERTICALLY MOVABLE BOTTOM

CROSS REFERENCE TO RELATED APPLICATION

This application claims the priority of German Application No. 100 40 066.3 filed Aug. 16, 2000, which is incorporated herein by reference.

BACKGROUND OF THE INVENTION

This invention relates to a coiler can having a vertically shiftable bottom provided with an internal bottom lifting device.

In a known device of the above-outlined type, as disclosed, for example, in European Patent No. 0 452 687, the lifting device is composed of two compression springs and a pantograph-type balancing system which press against the shiftable bottom from below. During filling of the coiler can the sliver entering the coiler can presses the bottom downward. When the coiler can is filled, the two compression springs and the balancing system are compressed to a certain height. It is a disadvantage of this arrangement that the bottom is not capable of being lowered all the way to the lower end of the coiler can since the bottom lifting system is accommodated within the coiler can underneath the bottom. This results in a loss of coiler can volume for the sliver. It is a further drawback that the known arrangement is of expensive construction.

SUMMARY OF THE INVENTION

It is an object of the invention to provide an improved device of the above-outlined type from which the discussed disadvantages are eliminated and which, in particular, allows a capacity increase of the coiler can in a structurally simple manner.

This object and others to become apparent as the specification progresses, are accomplished by the invention, according to which, briefly stated, the coiler can for accommodating sliver includes a vertical wall defining an inner can space and a can top through which sliver may be deposited into and withdrawn from the can space; a vertically shiftable bottom disposed in the inner can space; and a tension device connected to the shiftable bottom and exerting a pulling force thereto toward the can top.

By spring loading the shiftable bottom of the coiler can from above, the bottom can be lowered all the way to the lower end of the coiler can so that the coiler can may receive significantly greater sliver quantities than conventional coiler cans. A simple construction is feasible by arranging the tension element at least partially above the shiftable bottom. Also, the invention allows an economical manufacture of the coiler cans having a shiftable, spring-loaded bottom.

DESCRIPTION OF THE PREFERRED EMBODIMENTS

Figure 1:
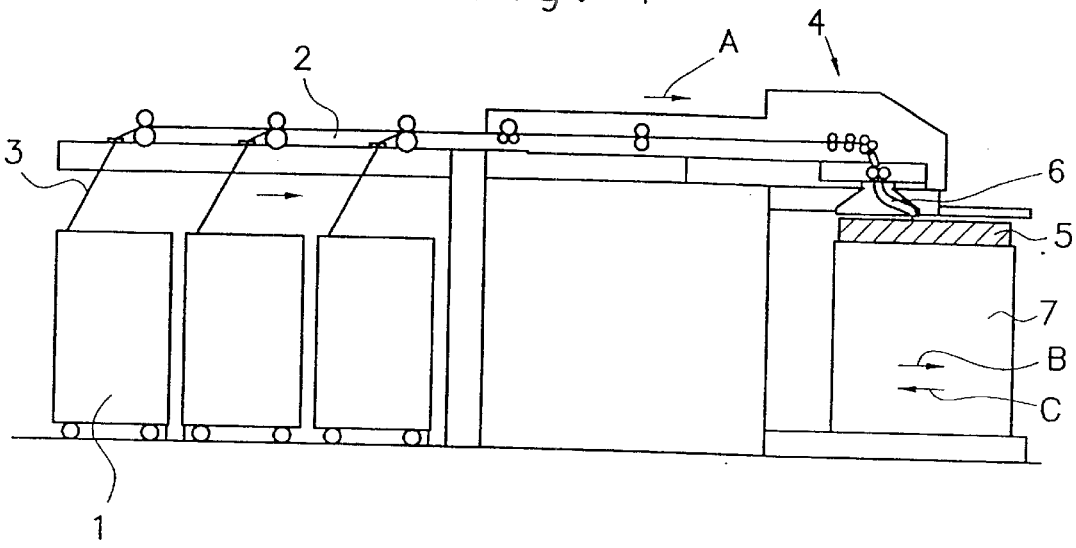
FIG. 1 is a schematic side elevational view of a draw frame in the process of charging a flat coiler can with sliver.

Turning to FIG. 1, coiler cans 1 of circular horizontal outline are positioned underneath a creel 2 of a draw frame which may be, for example, a high-performance HS model, manufactured by Trützschler GmbH & Co. KG, M önchengladbach, Germany. From each coiler can 1 a sliver 3 is withdrawn and introduced into a draw unit 4 in the direction A. After passing the draw unit 4 the processed sliver 5 is deposited in coils by a rotary head 6 of a sliver coiler in a coiler can 7 of flat, generally rectangular, horizontal outline. The coiler can 7 is positioned on a non-illustrated, driven sled for reciprocation in the direction of arrows B and C. The horizontal length dimension of the coiler can 7 extends parallel to the reciprocating direction B. C and its horizontal width generally corresponds to the deposited sliver coils.

Figure 2:
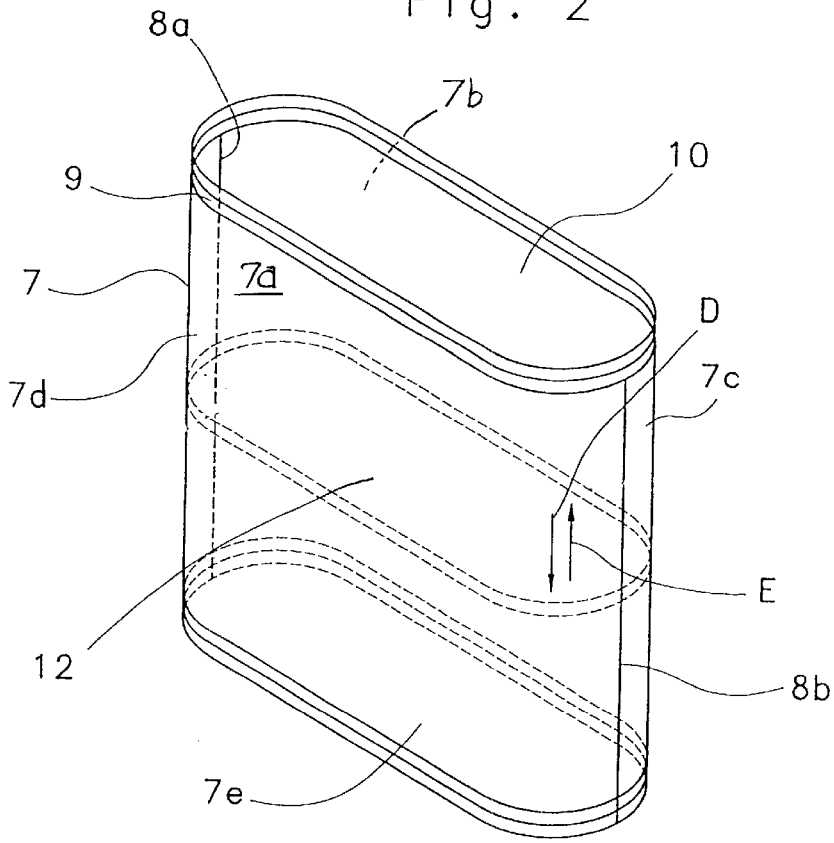
FIG. 2 is a perspective view of a flat coiler can having a vertically shiftable internal bottom.

Turning to FIG. 2, the flat coiler can 7 has a circumferential vertical wall composed of two identical panels which are made, for example, of a hard plastic material and which are joined along vertical seams 8*a* and 8*b*. The vertical coiler can wall has opposite wide sides 7*a* and 7*b* and opposite narrow sides 7*c* and 7*d*. The opposite narrow sides 7*c* and 7*d* are semicircular as viewed horizontally, to conform to the circular shape of the deposited sliver coils that adjoin the narrow sides 7*c* and 7*d*. At the lower end of the coiler can 7 the vertical wall is closed by a fixed bottom 7*e*. At the upper circumferential edge the vertical can wall is provided with a bead 9 which may be of metal and which secures the panels to one another. A similar bead may be provided along the lower circumferential edge of the vertical can wall. The coiler can 7 is open at the top.

A vertically shiftable bottom 12 which conforms to the horizontal outline of the coiler can 7 is positioned in the inner can space 10 and is vertically displaceable as indicated by the arrows D and E.

Figure 3A:
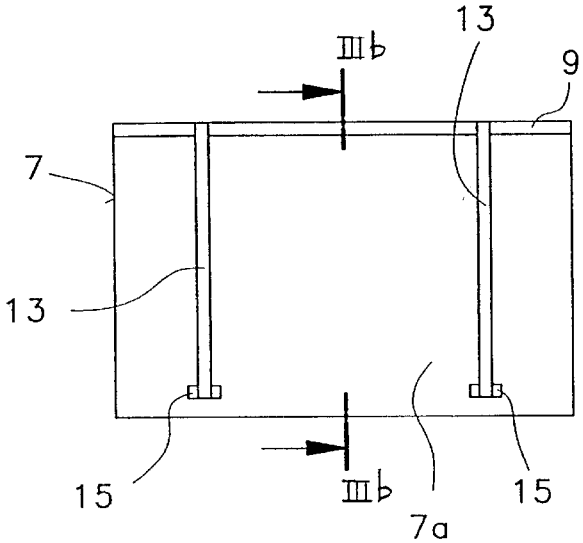
FIG. 3*a* is a schematic side elevational view of a flat coiler can incorporating a preferred embodiment according to the invention.
Figure 3B:
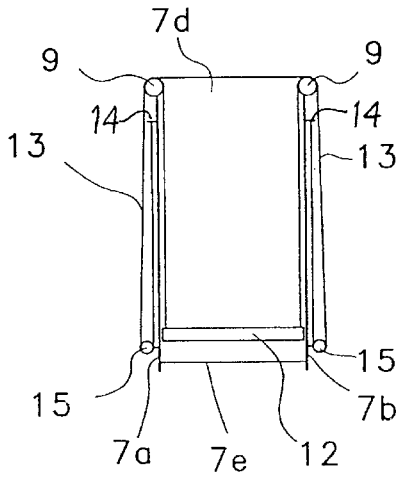
FIG. 3*b* is a sectional view taken along line IIIb—IIIb of FIG. 3*a*.
Figure 3C:
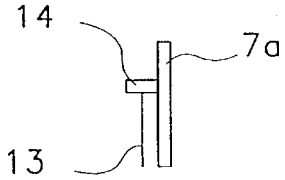
FIG. 3*c* is an enlarged detail illustrating the securement of a rubber band to a stationary support.

Turning to FIGS. 3*a*, 3*b* and 3*c*, four flat rubber bands 13, constituting tension elements, have one end secured to the bottom 12, then extend upward within the coiler can 7 and are trained about a deflecting element constituted, for example, by the rounded and smooth top bead 9. It is to be understood that the deflecting element may also consist of a roller. From the bead 9 the bands extend downward along the sides 7*a*, 7*b* and are trained about respective rounded deflecting surfaces 15, and then extend upward and are, at their other end, attached to respective posts 14 secured to the outside of the can wall. A downward pressure on the bottom element 12 caused by the weight of the sliver is opposed by the upwardly pulling tension force of the elastic bands 13. The resiliency of the elastic bands 13 is so designed that when the can is empty the bottom element 12 rises to the top of the can. By an appropriate coordination between the elasticity (spring characteristic) of the bands 13 and the weight of the sliver, a well-packed charging of the coiler can with sliver may be achieved. The fixed can bottom 7*e* has a very small distance (for example, 10 mm) from the floor on which the coiler can stands. Since the tension elements are not present in any way underneath the bottom 12, the latter may sink all the way into contact with the fixed can bottom 7*e*. The bottom 12 may be made, for example, of pressed synthetic material and may have a thickness of 10 mm.

Figure 4:
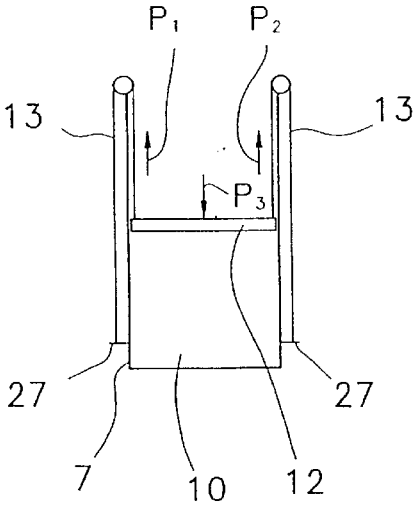
FIG. 4 is a schematic front elevational view of another preferred embodiment, illustrating pressing and pulling forces affecting the shiftable bottom as the coiler can is being filled.

In FIG. 4 the bottom 12 is depicted at about half-height of the coiler can 7, indicating that the can is about half filled with sliver (not shown for clarity). The pressing force $P_3$ is the increasing weight of the sliver during the filling operation as well as the filling force exerted by the coiler head 6 as it presses down on the sliver. Such a filling force is greater than the force derived from the sliver weight. The composite pressing force $P_3$ is opposed by the tension force of the elastic elements 13; such a tension force is, on both sides of the can, composed of partial tension forces $P_1$ and $P_2$. The elastic elements 13 are secured to the outside of the vertical can wall at respective posts 27.

FIGS. 5–9 illustrate additional advantageous embodiments of the invention.

Figure 5:
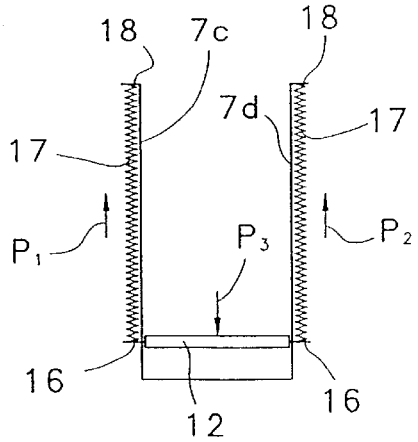
FIG. 5 is a schematic side elevational view of a further preferred embodiment including two tension springs and external projections affixed to the shiftable bottom.

According to FIG. 5, the bottom 12 has, at its longitudinal ends, two extensions 16 which project in opposite directions through vertical slots provided in the two end walls 7*c* and 7*d* of the coiler can. Two tension springs 17 positioned at either end of the coiler can are secured to the respective projections 16 and a respective post 18 at the top of the coiler can. The tension springs 17 (which, as an alternative, may be elastic bands) exert an upwardly oriented tension force on the shiftable bottom 12.

Figure 6:
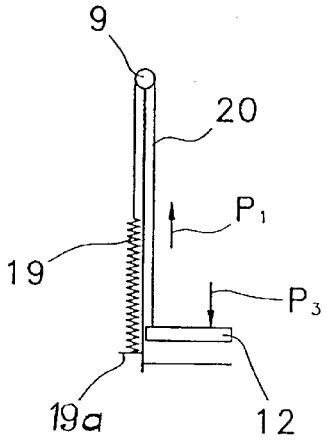
FIG. 6 is a fragmentary front elevational view of yet another preferred embodiment showing a two-part tension element composed of an elastic and an inelastic part.

In FIG. 6 a tension element is shown which is a two-part component. One part, which is non-elastic, consists of a wear-resistant and tension-resistant smooth strap 20 made, for example, of textile, metal or a fiber-reinforced material. The strap 20 has one end which is secured to the bottom 12 and is trained about the top bead 9 to slide thereon. The other end of the strap 20 is secured to the second component of the tension element, consisting of a resilient member such as a tension spring 19 or a rubber band whose free end is secured to a post 19*a* affixed to the outside of the can wall at the lower end thereof.

Figure 7:
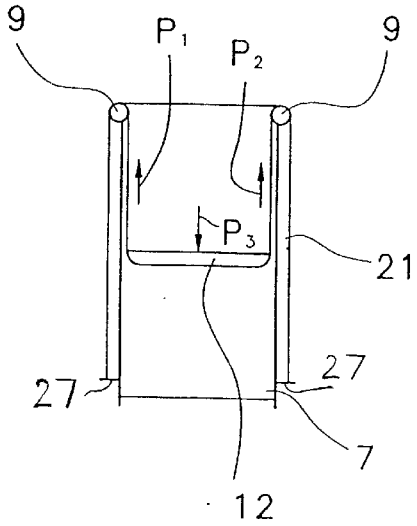
FIG. 7 is a schematic front elevational view of a further preferred embodiment of the invention including a one-piece elastic tension element.

According to FIG. 7, a one-piece tension element 21 is provided which may be an elastic band and which crosses the bottom 12 along its underside. For equilibrium and stability reasons, expediently two tension elements 21 are provided along the long side walls 7*a*, 7*b* of the can 7. If desired, that portion of the tension elements 21 which engage and carry the bottom 12 may be non-elastic.

Figure 8:
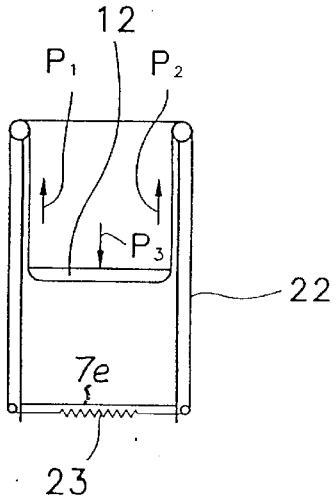
FIG. 8 is a schematic front elevational view of a coiler can of yet another preferred embodiment having an endless, two-part elastic tension element.

According to FIG. 8, an endless, two-part elastic tension element is provided whose one part is a non-elastic, wear-resistant belt 22 which passes underneath the bottom element 12 and externally along opposite vertical can walls and whose opposite ends are attached to an elastic tension element such as a spring 23, a rubber band or the like, extending underneath the fixed can bottom 7*e*.

Figure 9:
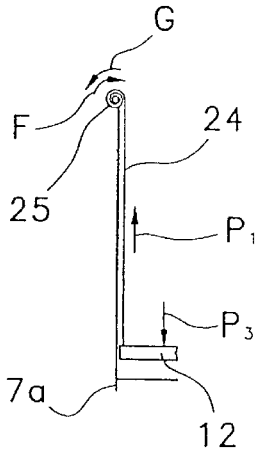
FIG. 9 is a fragmentary front elevational view of a coiler can showing a tension element wound on a spring-loaded winch.
Figure 9A:
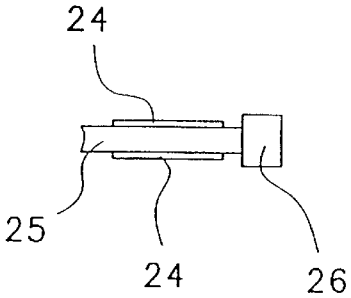
FIG. 9*a* illustrates a terminal region, on an enlarged scale, of the embodiment shown in FIG. 9 having a rotary spring.

According to FIG. 9 to the bottom 12 one end of a non-elastic band 24 is secured, whose other end is mounted on a winch 25 rotatable in the direction of the arrows F and G. The winch 25 is, as shown in FIG. 9*a*, provided with a rotary spring device 26 exerting an elastic torque on the winch 25 in the direction G to cause the band 24 to exert a tension force $P_1$ in an upward direction on the bottom 12 against a pressing force $P_3$. FIG. 9 only shows a single elastic, loaded tension element; for equilibrium and stability reasons expediently at least two tension elements are provided which can be rolled and unrolled by a respective winch 25.

Figure 10:
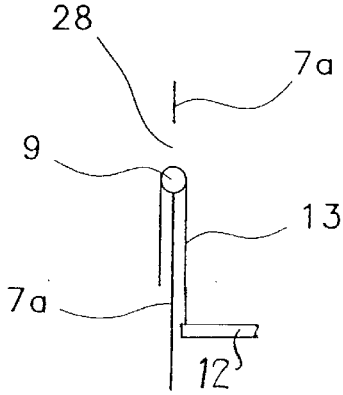
FIG. 10 is a fragmentary front elevational view of a coiler can, illustrating an opening therein through which a tension element passes.

In FIG. 10, in the side wall 7*a* (as well as in the non-illustrated side wall 7*b*) a throughgoing opening 28 is provided through which the tension element may pass and may thus be deflected. The edge surface of the opening 28 is expediently rounded and smooth.

The tension and pressing forces shown in FIG. 4 apply equally to a sliver charging process, for example, at the outlet of a draw frame as shown in FIG. 1 or a sliver withdrawing process from the coiler can, for example, in an open-end spinning machine.

It will be understood that the above description of the present invention is susceptible to various modifications, changes and adaptations, and the same are intended to be comprehended within the meaning and range of equivalents of the appended claims.

What is claimed is:

1. A coiler can for accommodating sliver, comprising (a) a vertical wall defining an inner can space and a can top through which sliver may be deposited into and withdrawn from said inner can space; said vertical wall including opposite first and second sides;

(b) a vertically shiftable bottom disposed in said inner can space; said first and second sides flanking said bottom; and (c) a tension device connected to said shiftable bottom and exerting a pulling force thereto toward said can top; said tension device including (1) a first deflecting element secured to an upper edge region of said first side of said vertical wall;

(2) a second deflecting element secured to a bottom edge region of said first side of said vertical wall;

(3) a third deflecting element secured to an upper edge region of said second side of said vertical wall;

(4) a fourth deflecting element secured to a bottom edge region of said second side of said vertical wall; and (5) an elongate tension element having an elastic length portion; said tension element being connected to said bottom and extending upward from opposite sides of said bottom and being trained about respective said first and second deflecting elements; said elongate tension element extending downward from said first and second deflecting elements and being trained about respective said third and fourth deflecting elements, whereby said tension element extends between said third and fourth deflecting elements in the bottom region of said first and second sides of said vertical wall.

2. The coiler can as defined in claim 1, wherein said tension element is endless and extends along and in engagement with an underside of said bottom between said first and second sides of said vertical wall.

3. The coiler can as defined in claim 1, wherein said tension element has an elastic length portion solely between said third and fourth deflecting elements.

4. A coiler can for accommodating sliver, comprising (a) a vertical wall defining an inner can space and a can top through which sliver may be deposited into and withdrawn from said inner can space;

(b) a vertically shiftable bottom disposed in said inner can space; and (c) a tension device connected to said shiftable bottom and exerting a pulling force thereto toward said can top; said tension device including (1) a tension element connected to said bottom and extending upward therefrom; and (2) a spring-loaded winch secured to an upper edge region of said vertical wall; said tension element being wound on said winch and being resiliently urged upward by said winch for exerting an upward pulling force to said bottom.

5. A coiler can for accommodating sliver, comprising (a) a vertical wall defining an inner can space and a can top through which sliver may be deposited into and withdrawn from said inner can space;

(b) a vertically shiftable bottom disposed in said inner can space; and (c) a tension device connected to said shiftable bottom and exerting a pulling force thereto toward said can top; said tension device including (1) a tension element connected to said bottom and extending upward therefrom;

(2) an aperture provided in said vertical wall; and (3) a deflecting element mounted on said vertical wall in a region of said aperture; said tension element being trained about said deflecting element and passing through said aperture from said inner space.

6. A coiler can for accommodating sliver, comprising (a) a vertical wall defining an inner can space and a can top through which sliver may be deposited into and withdrawn from said inner can space;

(b) a vertically shiftable bottom disposed in said inner can space; and (c) a tension device connected to said shiftable bottom and exerting a pulling force thereto toward said can top; said tension device including an elastic tension element having a first end exerting an upward force to said bottom and a second end secured stationarily; said second being attached externally to said vertical wall.

7. A coiler can for accommodating sliver, comprising (a) a vertical wall defining an inner can space and a can top through which sliver may be deposited into and withdrawn from said inner can space;

(b) a vertically shiftable bottom disposed in said inner can space; and (c) a tension device connected to said shiftable bottom and exerting a pulling force thereto toward said can top; said tension device including (1) an elastic tension element exerting an upward force to said bottom; and (2) a deflecting element mounted on an upper edge region of said vertical wall; said tension element being trained about said deflecting element as it passes from said inside space outward.

8. The coiler can as defined in claim 7, wherein said deflecting element is a roller.

9. A coiler can for accommodating sliver, comprising (a) a vertical wall defining an inner can space and a can top through which sliver may be deposited into and withdrawn from said inner can space;

(b) a vertically shiftable bottom disposed in said inner can space; and (c) a tension device connected to said shiftable bottom and exerting a pulling force thereto toward said can top; said tension device including a tension element connected to said bottom and exerting an upward pulling force thereto; said tension element being deflected by said bottom and extending along and in contact with an underside thereof.

10. A coiler can for accommodating sliver, comprising (a) a vertical wall defining an inner can space and a can top through which sliver may be deposited into and withdrawn from said inner can space;

(b) a vertically shiftable bottom disposed in said inner can space; and (c) a tension device connected to said shiftable bottom and exerting a pulling force thereto toward said can top; said tension device including a tension element connected to said bottom and exerting an upward pulling force thereto; said tension element having elastic and non-elastic length portions; the non-elastic length portion being connected to said bottom.

* * * * *